US006116650A

United States Patent [19]

Nijboer et al.

[11] Patent Number: 6,116,650

[45] **Date of Patent: *Sep. 12, 2000**

[54] RECORD PAD WITH ADJACENT RECORD ASSEMBLY

[75] Inventors: Anton Nijboer; Fokke Jager, both of Drachten; Henry W. Dingley, Nederhorst D Berg, all of Netherlands

[73] Assignee: Moore Business Forms, Inc., Grand Island, N.Y.

[ * ] Notice: Under 35 U.S.C. 154(b), the term of this patent shall be extended for 68 days.

[21] Appl. No.: 08/589,250

[22] Filed: Jan. 23, 1996

[30] Foreign Application Priority Data

Jan. 27, 1995 [NL] Netherlands ..... 9500156

[51] Int. Cl.[7] ..... B42D 1/00

[52] U.S. Cl. ..... 281/16; 402/79

[58] Field of Search ..... 281/16, 15.1, 21.1, 281/38, 45; 402/79

[56] References Cited

U.S. PATENT DOCUMENTS

| | | | |
|---|---|---|---|
| 3,945,870 | 3/1976 | Johnsen . | |
| 4,533,160 | 8/1985 | Malone . | |
| 4,934,740 | 6/1990 | Drake | 281/16 |
| 5,328,409 | 7/1994 | Marquardt . | |

FOREIGN PATENT DOCUMENTS

| | | |
|---|---|---|
| 325057 | 7/1989 | European Pat. Off. . |
| 486127 | 5/1992 | European Pat. Off. . |
| 2435049 | 2/1975 | Germany . |

*Primary Examiner*—Willmon Fridie, Jr.
*Attorney, Agent, or Firm*—Nixon & Vanderhye P.C.

[57] ABSTRACT

A record pad is provided having upper and lower margins and side margins for a plurality of sheet sets. Each set includes a paper top sheet and at least one underlying record bottom sheet with a transfer mechanism (such as carbonless coatings) for transferring indicia imaged on the top sheet to an underlying record sheet. A securing edge margin of each sheet set is provided at the first side margin, with a pattern (such as a continuous strip) of repositional adhesive provided adjacent the securing edge margin and substantially parallel to the first side margin, but spaced from the securing edge margin so as to minimize the amount of adhesive utilized, and to maximize the ease of removability of the top sheet from the pad. A line of weakness (such as a perforation) is preferably provided between securing edge margins and the strip of repositional adhesive, and other lines of weakness may be provided in the top sheet substantially parallel to the upper margin to divide the top sheet into readily separable individual notes or business forms.

20 Claims, 1 Drawing Sheet

RECORD PAD WITH ADJACENT RECORD ASSEMBLY

BACKGROUND AND SUMMARY OF THE INVENTION

Conventional record pads having a plurality of sheet sets with a top paper sheet having top and bottom faces, and at least one underlying record bottom sheet, with a transfer mechanism (such as carbonless coatings or carbon paper) for transferring indicia imaged on the top sheet to an underlying record sheet, are illustrated in European patent 325,057. In such a record pad, a ring binder element is provided at the left hand margin of the record pad attached to cooperating securing edge margins of each sheet set of the plurality of sheet sets, and a strip of repositional adhesive is provided on the bottom face of the top sheet at the securing edge margin, extending on both sides of a perforation line substantially parallel to the side margin and allowing ready separation of the top sheet from the record pad.

According to the present invention an improved record pad is provided which eliminates the adhesive on the securing edge margins (that is the securing edge margins are substantially free of adhesive) with the securing edge margins being spaced from the pattern of repositional adhesive provided on the top sheet. This provides a construction in which it is easier to remove the copy sheet from the record pad, leaving its securing edge margin (if provided) secured to the record pad, while additionally utilizing less adhesive. Desirably, both the copy sheet and the record sheet have corresponding securing edge margins which are substantially free of adhesive, thus making it possible to secure the multiple sheets to each other with a mechanical securing mechanism (such as a ring, staples, or the like), or adhesive, without the risk of sheet sets sliding out of position.

According to one aspect of the present invention a record pad is provided comprising the following components: A plurality of sheet sets, each sheet set comprising a paper top sheet having a top face and a bottom face, at least one underlying record bottom sheet, and a transfer mechanism for transferring indicia imaged on the top sheet to an underlying record sheet. The top sheet comprises an upper margin, a lower margin substantially parallel to the upper margin, and first and second side margins substantially perpendicular to the upper and lower margins, the upper margin being at the upper portion of the top sheet during normal use of the top sheet to enter indicia on the top sheet. A securing edge margin of each of the top and record sheets of each sheet set of the plurality of sheet sets is at the first side margin for connecting the sheet sets in a record pad. And a pattern of repositional adhesive is provided on each the top sheet bottom face adjacent to and substantially parallel to the securing edge margins, the securing edge margins being substantially free of adhesive and spaced from the pattern of repositional adhesive.

Preferably a line of weakness (such as a perforation line) is provided in each top sheet extending substantially parallel to the securing edge margin, and the pattern of repositional adhesive is on the opposite side of the line of weakness from the securing edge margin. Typically the pattern of repositional adhesive is a substantially continuous linear strip of adhesive, although discontinuous strips, or other patterns of dots or the like may also or alternative be provided. Preferably the strip of adhesive is spaced from an associated line of weakness a distance of about 1–5 mm, preferably 2 mm.

Typically the top sheet upper and lower margins are shorter than the top sheet side margins. In the preferred embodiment at least one additional line of weakness (such as a perforation line) is provided dividing the top sheet into a number of portions, each portion readily separable along the line of weakness from the rest of the top sheet. Each separable portion preferably has a dimension parallel to the upper margin which is longer than the dimension parallel to the side margin.

A mechanical attachment (such as staples, a conventional ring binder, or the like) is provided adjacent the securing edge margin connecting all of the sheet sets together, and a foldable flap acting as a writing shield is also provided. The transfer mechanism may be any suitable conventional transfer mechanism such as CF/CB cooperating coatings, a self-contained, self-imaging carbonless coating on or more record sheets, carbon paper, or the like.

The repositional adhesive may be any suitable conventional repositional adhesive. For example, it may be a repositional adhesive sold by Moore Business Forms of Lake Forest, Illinois under the trademark "CLEANTAC"®, or it may be the repositional adhesive provided on the 3M "POST-IT"® products or such as shown in Swiss patent 452,479.

According to another aspect of the present invention a record pad is provided comprising: A plurality of sheet sets, each sheet set comprising a paper top sheet having a top face and a bottom face, at least one underlying record bottom sheet. The top sheet comprising an upper margin, a lower margin substantially parallel to the upper margin, and first and second side margins substantially perpendicular to the upper and lower margins, the upper margin being at the upper portion of the top sheet during normal use of the top sheet to enter indicia on the top sheet. A securing edge margin of each of the top and record sheets of each sheet set of the plurality of sheet sets for connecting the sheet sets in a record pad at the first side margin. A pattern of repositional adhesive provided on each the top sheet bottom face adjacent to and substantially parallel to the securing edge margins, the securing edge margins being substantially free of adhesive and spaced from the pattern of repositioned adhesive. And a line of weakness in each the top sheet extending substantially parallel to the securing edge margin, the pattern of repositional adhesive on the opposite side of the line of weakness from the securing edge margin. Details of the record pad portions are preferably as described above.

It is a primary object of the present invention to provide an advantageous record pad with top sheets, the top sheet portions having repositional adhesive associated therewith. This and other objects of the invention will become clear from an inspection of the detailed description of the invention and from the appended claims.

DETAILED DESCRIPTION OF THE DRAWINGS

Figure 1:
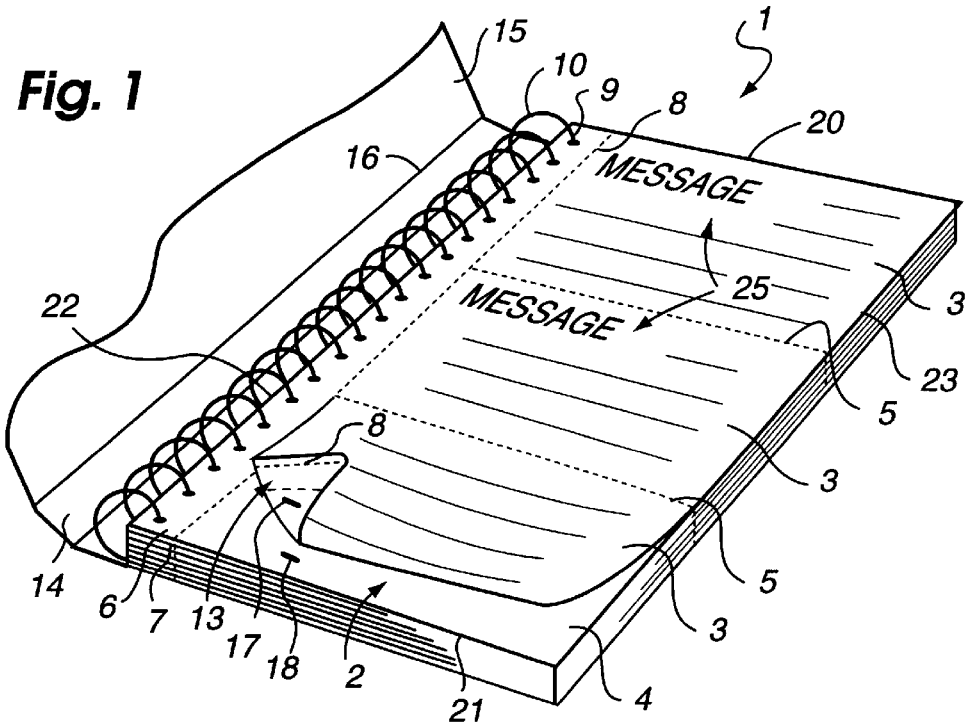
FIG. 1 is a top perspective view, with portions of a foldable writing shield cut away for clarity of illustration and with a portion of one of the top sheets folded back, of an exemplary record pad according to the present invention.
Figure 2:
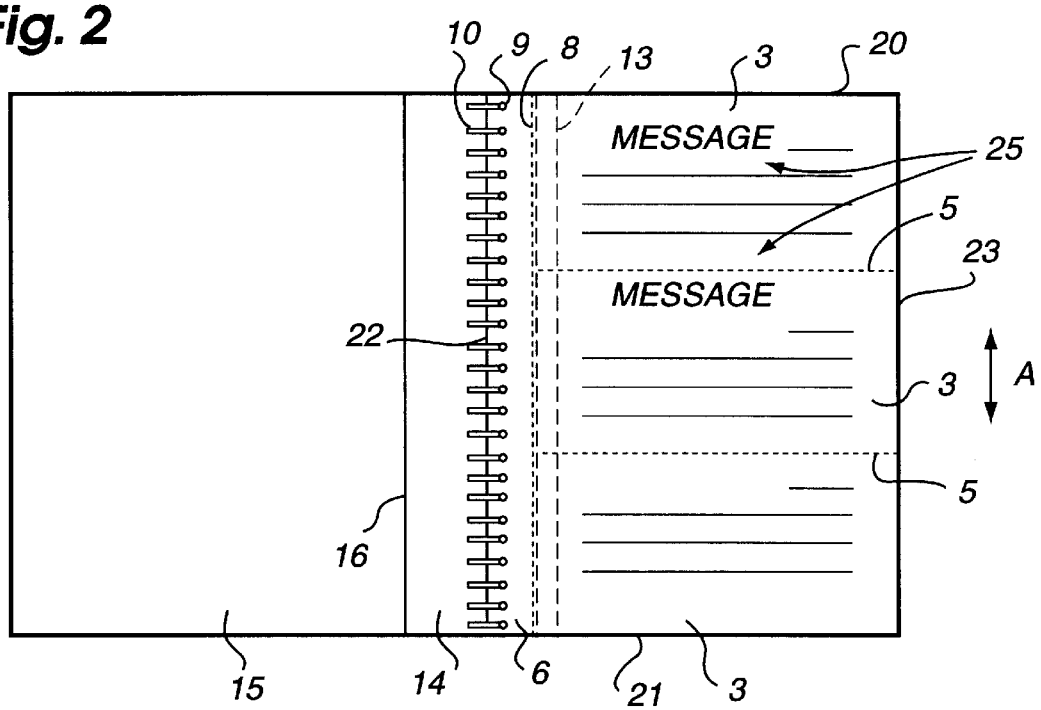
FIG. 2 is a top plan view of the record pad of FIG. 1.
Figure 3:
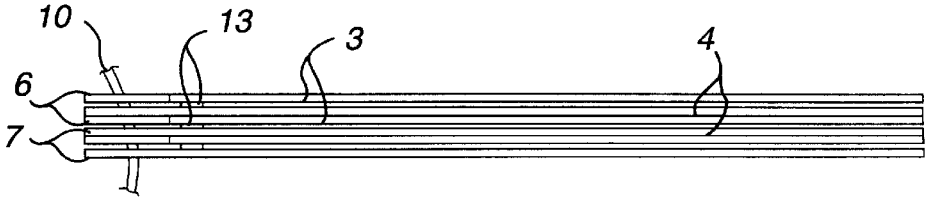
FIG. 3 is an end view of the record of FIGS. 1 and 2.

An exemplary record pad according to the present invention is shown generally by reference numeral 1 in FIGS. 1–3. A plurality of sheet sets 2 are arranged in close juxtaposition to each other. Each set 2 includes a paper top sheet 3 having a top face and a bottom face, the top face primarily being seen in FIG. 1 but the bottom face being visible at one corner of the bottom third of the top sheet 3 in FIG. 1. Each set 2 also includes at least one underlying record bottom sheet 4 with a transfer mechanism provided for transferring indicia imaged on the top sheet 3 top face to an underlying record sheet 4. The transfer means may comprise any suitable mechanism such as a CB top sheet 3 and CF bottom sheet 4, or a self-contained self-imaging carbonless coating on the record sheet 4, or a sheet of carbon paper (not shown). Carbonless coatings are preferred.

For example, the transfer mechanism may comprise a CB coating 17 (see FIG. 1) on the top sheet 3 and a CF coating 18 (see FIG. 1) on record sheet 4; or-a self-contained, self-imaging carbonless coating may be provided on the record sheet 4; or carbon paper (not shown) or the like may be utilized, as well as any other conventional alternatives for transferring indicia imprinted on the top sheet 3 to its associated record sheet 4 (or record sheets, if a plurality of record sheets are associated with a single top sheet 3).

Preferably the top sheet 3 has an upper margin 20, and for lower portions of the top sheet 3 the perforation (or other lines of weakness) lines 5 are preferred. A securing edge margin is provided for each sheet set 2. In the embodiment illustrated in FIG. 1 a securing margin 6, 7 may be provided for each of the top sheet 3 and the record sheet 4, respectively, which may include openings 9 for attachment to a conventional ring binder element 10, and separated from the body of sheet 3 by a line of weakness (e.g. perforation line) 8. However because repositional adhesive strips are utilized as will be described below, it is not always essential to provide the securing edge margin 6, rather only the edge margin 7 need necessarily be provided, although both margins 6, 7 are preferred.

A pattern of repositional adhesive 13 is provided on each top sheet 3 bottom face adjacent the line of weakness 8 substantially parallel thereto. The upper margin 20 is parallel to the lower margin 21, and they are both transverse to first and second side margins 22, 23. As seen most clearly in both FIGS. 1 and 2, while the pattern 13 is adjacent the perforation 8 it is preferably slightly spaced therefrom, e.g. about 1–5 mm, preferably about 2 mm.

As seen in FIGS. 1 through 3 preferably for the entire top sheet 3 the side edges 22, 23 are significantly longer than the upper and lower margins 20, 21, but for each of the three different portions (defined by perforations 5) that are separable from the top sheet 3 as illustrated in the drawings the edges parallel to the upper margin 20 are longer than the side edges, providing a rectangular configuration.

The adhesive pattern 13 may comprise a substantially continuous repositional adhesive strip, or discontinuous strips, or other patterns such as series of dots or other shapes and preferably the adhesive is the CLEANTAC® or other adhesives desired above. There is no adhesive on the securing edges 6, 7 (although a permanent adhesive and/or staples, or the like may be used in place of ring 10).

It is preferred that there be indicia printed or otherwise imaged on the top sheet 3 when the record pad 1 is sold. This indicia—for example schematically illustrated by the word "Message" in FIGS. 1 and 2—is to facilitate utilization of the top sheet 3, or portions of the top sheet 3, as message notes or business forms. The orientation of the letters of the indicia 25—as seen in FIGS. 1 and 2—is such that the margin 20 is the upper margin during use, and the margin 22 the left hand margin.

In the preferred embodiment a foldable flap 15 is also preferably provided, for example providing the front cover of the record pad 1 with a sheet of cardboard 14 connected to the mechanical attachment 10, and the flap 15 foldable about an axis parallel to the side edges (e.g. 22, 23) of the top sheet 3 e.g. foldable about fold line 16. The flap can be inserted between the uppermost sheet set 2 of the record pad 1 and the next succeeding sheet set 2 in order to prevent indicia imprinted on the uppermost top sheet 3 from transferring (through the transfer mechanism, such as carbon paper or carbonless coatings) to underlying record sheets 4 in the pad 1. The flap 15 may be adjacent the edges 23, 20 or 21 instead of edge 22. That is the foldable flap 15 acts as a writing shield.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A record pad comprising:

a plurality of sheet sets, each sheet set comprising a paper top sheet having a top face and a bottom face, at least one underlying record bottom sheet, and a transfer mechanism for transferring indicia imaged on said top sheet to an underlying said record sheet;

said top sheet comprising an upper margin, a lower margin substantially parallel to said upper margin, and first and second side margins substantially perpendicular to said upper and lower margins, said upper margin being at the upper portion of said top sheet during normal use of said top sheet to enter indicia on said top sheet;

a securing edge margin of each of said top and record sheets of each sheet set of said plurality of sheet sets at said first side margin for connecting said sheet sets in a record pad; and a pattern of repositional adhesive provided on each said top sheet bottom face adjacent to and substantially parallel to said securing edge margins, said securing edge margins being substantially free of adhesive and spaced from said pattern of repositional adhesive.

2. A record pad as recited in claim 1 further comprising a line of weakness in each said top sheet extending substantially parallel to said securing edge margin, said pattern of repositional adhesive on the opposite side of said line of weakness from said securing edge margin.

3. A record pad as recited in claim 2 wherein said pattern of repositional adhesive is a substantially continuous linear strip of adhesive.

4. A record pad as recited in claim 3 wherein said strip of adhesive is spaced from said line of weakness a distance of between about 1–5 mm.

5. A record pad as recited in claim 3 wherein said strip of adhesive is spaced from said line of weakness a distance of about 2 mm.

6. A record pad as recited in claim 1 wherein said top sheet upper and lower margins are shorter than said top sheet side margins.

7. A record pad as recited in claim 1 further comprising a mechanical attachment adjacent said securing edge margin connecting all of said sheet sets together, and a line of weakness between said top sheet and said mechanical attachment.

8. A record pad as recited in claim 1 further comprising a foldable flap.

9. A record pad as recited in claim 1 wherein said pattern of repositional adhesive is a substantially continuous linear strip of adhesive.

10. A record pad as recited in claim 2 wherein said pattern of adhesive is spaced from said line of weakness a distance of between about 1–5 mm.

11. A record pad as recited in claim 3 further comprising a mechanical attachment adjacent said securing edge margin connecting all of said sheet sets together, and a line of weakness between said top sheet and said mechanical attachment.

12. A record pad as recited in claim 6 further comprising at least one line of weakness extending substantially parallel to said upper margin and dividing said top sheet into at least two portions, each portion having a dimension parallel to said upper margin longer than a dimension thereof parallel to said first side margin.

13. A record pad as recited in claim 2 further comprising at least one line of weakness extending substantially parallel to said upper margin and dividing said top sheet into at least two portions, each portion having a dimension parallel to said upper margin longer than a dimension thereof parallel to said first side margin.

14. A record pad comprising:

a plurality of sheet sets, each sheet set comprising a paper top sheet having a top face and a bottom face, at least one underlying record bottom sheet;

said top sheet comprising an upper margin, a lower margin substantially parallel to said upper margin, and first and second side margins substantially perpendicular to said upper and lower margins, said upper margin being at the upper portion of said top sheet during normal use of said top sheet to enter indicia on said top sheet;

a securing edge margin of each of said top and record sheets of each sheet set of said plurality of sheet sets for connecting said sheet sets in a record pad at said first side margin;

a pattern of repositional adhesive provided on each said top sheet bottom face adjacent to and substantially parallel to said securing edge margins, said securing edge margins being substantially free of adhesive and spaced from said pattern of repositioned adhesive; and a line of weakness in each said top sheet extending substantially parallel to said securing edge margin, said pattern of repositional adhesive on the opposite side of said line of weakness from said securing edge margin.

15. A record pad as recited in claim 14 wherein said pattern of repositional adhesive is a substantially continuous linear strip of adhesive.

16. A record pad as recited in claim 15 wherein said strip of adhesive is spaced from said line of weakness a distance of between about 1–5 mm.

17. A record pad as recited in claim 14 wherein said pattern of adhesive is spaced from said line of weakness a distance of about 2 mm.

18. A record pad as recited in claim 14 wherein said top sheet upper and lower margins are shorter than said top sheet side margins.

19. A record pad as recited in claim 14 further comprising a mechanical attachment adjacent said securing edge margin connecting all of said sheet sets together, and a line of weakness between said top sheet and said mechanical attachment.

20. A record pad as recited in claim 14 further comprising at least one line of weakness extending substantially parallel to said upper margin and dividing said top sheet into at least two portions, each portion having a dimension parallel to said upper margin longer than a dimension thereof parallel to said first side margin.

* * * * *